US005249310A

United States Patent [19]

Forte

[11] Patent Number: 5,249,310

[45] Date of Patent: Oct. 5, 1993

[54] INSECT DETECTOR SOCK

[76] Inventor: Mark J. Forte, 180 Gritteytown Rd., Waterbury, Conn. 06704

[21] Appl. No.: 897,758

[22] Filed: Jun. 12, 1992

[51] Int. Cl.[5] ..... A43B 17/00; A41D 17/02

[52] U.S. Cl. ..... 2/239; 2/242; 36/2 R

[58] Field of Search ..... 2/239, 242, 2, 16, 22, 2/23, 61; 36/1.5, 2 R; 43/114, 115, 121, 136

[56] References Cited

U.S. PATENT DOCUMENTS

| | | | |
|---|---|---|---|
| 20,069 | 4/1858 | Johnson | 2/239 |
| 332,630 | 12/1885 | Way | 36/2 R |
| 380,163 | 3/1988 | Beatty | 2/239 |
| 1,594,086 | 7/1926 | Arnold | 36/2 R |
| 1,775,714 | 9/1930 | Bass | 36/2 R |
| 4,244,121 | 1/1981 | Adams | 36/2 R |
| 4,282,728 | 8/1981 | Tapp et al. | 2/239 |
| 4,599,812 | 7/1986 | Harmsen | 2/239 |
| 4,800,671 | 1/1989 | Olson | 43/114 |
| 4,862,638 | 9/1989 | Stevenson | 43/114 |
| 4,964,176 | 10/1990 | Previdi | 2/242 |
| 5,003,635 | 4/1991 | Peterson | 2/DIG. 11 |
| 5,005,215 | 4/1991 | McIlguham | 36/2 R |
| 5,035,008 | 7/1991 | Schneider | 2/242 |
| 5,067,177 | 11/1991 | Binder | 2/242 |
| 5,097,537 | 3/1992 | Ewing | 2/239 |
| 5,157,791 | 10/1992 | Woodson et al. | 2/239 |

*Primary Examiner*—Clifford C. Crowder
*Assistant Examiner*—Amy B. Vanatta
*Attorney, Agent, or Firm*—Lawrence Hager

[57] ABSTRACT

An article of clothing for detecting and monitoring the level of infestation of ticks, and other crawling insects. The article of clothing can be in the form of a stocking having an upper legging section that encircles portions of the trouser's legs. One or more circumferential bands are provided about the upper section of the stocking for collecting and entrapping the ticks, etc. The stocking is formed of a material and color to attract and facilitate insect gathering on the stocking.

7 Claims, 1 Drawing Sheet

INSECT DETECTOR SOCK

FIELD OF THE INVENTION

This invention relates to an insect detection means for locating regions and extent of infestation. and, more particularly, to an article of clothing designed to attract and collect ticks and other insects.

BACKGROUND OF THE INVENTION

Heretofore, pest control agents used laborious visual search techniques in their attempts to locate the areas of insect infestations within structures and about the lawns and yards.

Due to the difficulties of visually locating the infestation regions, exterminators frequently are required to apply excessive amounts of poisons to assure eradication. Such over spraying may present environmental and health hazards.

The present invention has been developed and field tested to facilitate determination of the exact areas, types and relative extent of insect infestation. In this manner, the extent and type of poison can be tailored to effect eradication while minimizing hazard to humans.

BRIEF DESCRIPTION OF SOME PRIOR ART PATENTS

U.S. Pat. No. 5,005,215 issued Apr. 9, 1991 to Carl J. McIlquham shows a chap device designed to protect and repel ticks and other insects. A repellant is provided about the chap. The chap is formed of a tightly woven nylon to form a slippery and therefore difficult surface for a tick to grasp.

In total contrast with the '215 patent, the present invention has as some objectives to attract (not repel) ticks and other insects and to provide surface to facilitate grasping and clinging of ticks and insects on the detector sock.

U.S. Pat. No. 4,282,728 issued Aug. 11, 1981 to Robert H. Tapp and Clarence W. Wall teaches a knee protective sock for skateboarding.

This patent does not show or suggest an insect detector sock.

U.S Pat. No. 2,741,770 issued Jul. 8, 1953, to M. Tannen describes a rubber sock for inclement weather.

This patent also does not show or suggest, the present inventive insect detector sock designed to attract and collect ticks for relatively easy identification and location are infestations.

Other patents of general interest include U.S. Pat. No. 2,244,871 to Guinzburg; U.S. Pat. No. 1,643,620 to F. S. Dilger; and U.S. Pat. No. 1,594,086 to C. F. Arnold.

OBJECTS OF THE INVENTION

Thus, it is an object of the present invention to provide an article of clothing that is designed to attract ticks.

It is another object of the present invention to provide an article of clothing that facilitates insect grasping thereonto.

It is another object of the present invention to provide an article of clothing to collect ticks.

It is another object of the present invention to provide an article of clothing having a surface designed to attract and retain ticks and other insects.

It is another object of the present invention to provide an insect protective sock.

It is another object of the present invention to provide an insect detector sock.

It is another object of the present invention to provide an insect detector sock having a surface color selected to attract ticks.

It is another object of the present invention to provide an insect detector sock having a surface color selected to facilitate visually spotting ticks on said sock.

It is another object of the present invention to both attract ticks and to protect the wearer from being attacked by the attracted ticks.

It is another object of the present invention to provide an insect detector sock which will impede the upward movement of ticks, thus minimizing the chances of the user's skin coming in contact with ticks without the use of repellents.

It is another object of the present invention to provide an improved method of locating regions of tick infestation.

The foregoing and other objects and advantages of the invention will be evident from the following description. In the description, particular reference is made to the drawings which are provided by way of illustration of a preferred embodiment of the invention.

SUMMARY OF THE INVENTION

An insect detector article of clothing having particular utility when worn by an insect infestation inspector, comprising:

a sock like member (11,21);

legging means (12,23) affixed to said sock member being sized to accommodate a portion of the trousered leg of the insect infestation inspector and designed to provide a protective covering, said legging means being formed of a material selected for enabling insects to grasp and cling unto said legging means.

A method of inspecting a premises for ticks and other insects by a pest control inspector comprising the steps of:

placing an insect detector sock means (10, 20) on each leg of the pest control inspector, said insect detector sock means having a portion (12,21) designed to attract and facilitate grasping by ticks and other insects;

walking about the premises at a speed to enable ticks and other insects to accumulate on said portion (12,21) of the insect detector sock means;

observing the places about the premises where ticks and other insects lodge on the detector sock means;

whereby the pest control inspector may more readily and in relatively less time determine the location and extent of tick and other insect infestation about the inspected premises.

DETAILED DESCRIPTION OF THE PREFERRED EMBODIMENTS

Figure 1:
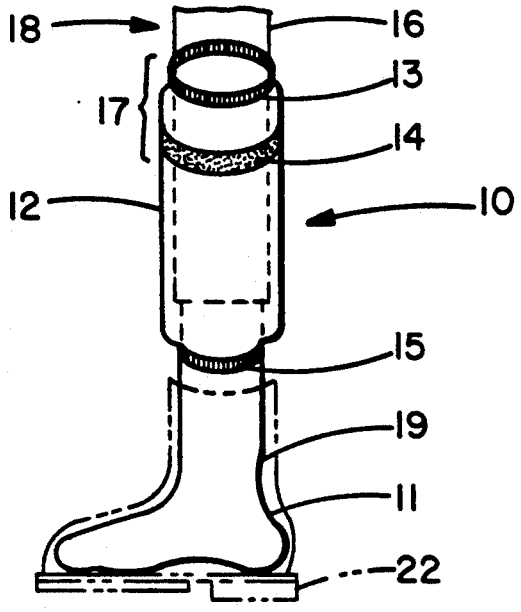
FIG. 1 is a perspective view of a sock designed in accordance with the invention.
Figure 2:
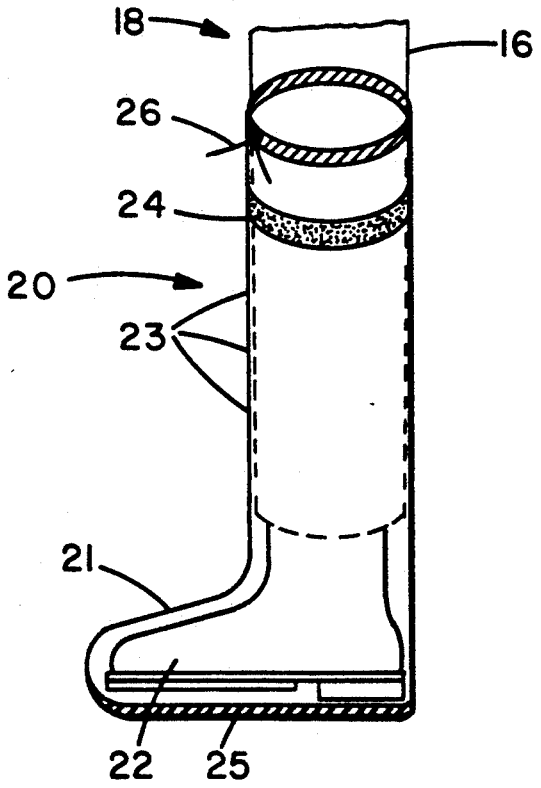
FIG. 2 is a perspective view of an alternative embodiment of the invention.

An insect detector sock 10 in accordance with the present invention is shown in FIGS. 1–2. The first preferred embodiment of the invention will be understood by reference to FIG. 1.

The insect detector sock 10 generally includes a lower foot member 11, an upper insect gathering member 12, an elastic band 13 and an insect barrier band 14.

The lower foot member 11 may be formed of any suitable material and is dimensioned to accommodate a wearer's foot in customary manner to typical socks.

The upper insect gathering member 12 is circumferentially sewn to the lower sock member 11. A stretch type stitching 15 is used to provide a secure fit about the wearer's leg. The upper insect gathering member 12 is formed of a material, for example, cotton or other suitable fabrics, which is not smooth and, therefore, will enable a tick to grasp and cling unto said insect gathering member 12. Insect gathering member 12 is also preferably formed of a color, e.g. white, which will both attract ticks and facilitate the pest control inspector to see and count the gathered ticks. In this manner, the pest control inspector (partially shown) is able to locate the nest or insect population regions and extent of infestation substantially more readily than heretofore possible. The upper insect gathering member 12 is sized and designed to fit comfortably over and around the leg and trousers of the user, while providing ample space for movement. Upper insect gathering member 12 is also sized so as to extend upwardly to a desired position on the user's legs, for example, above the knee.

An elastic band 13 is sewn unto the top of the upper insect gathering member 12 to secure said upper member 12 in place over the user's leg and trousers 16. The elastic band 13 may be of any suitable material having the desired elasticity.

An insect barrier ring 14 is affixed in conventional manner about a top portion 17 of upper member 12. Barrier ring 14 may comprise a double sided tape or other suitable substance-strip. The purpose of barrier ring 14 is to provide a barrier means to prevent ticks and other insects from crawling upwardly and coming into contacts with the trousers or skin of the pest control agent. The double sided tape, i.e., barrier ring 14, may be readily removed and replaced as required or desired with each use of the detector sock, for example, with each new job or daily. The function of barrier ring 14 is similar in manner as so called fly-paper, with the exception that the adhesive paper is used to trap ticks and other crawling insects instead of flies. In fact, it may be possible to wrap a strip of fly-paper about top portion 17 as an insect barrier means 14.

It should now be clearly understood that an important object of the insect detector sock 10 is to attract and collect/retain ticks on the insect detector sock 10 to aid an exterminator or other persons to locate the areas of a structures, home, building and yards, etc. where ticks (and other crawling type insects) are, and the relative level of infestation of such insects thereabout.

OPERATION OF THE PREFERRED EMBODIMENT

The operation of the preferred embodiment of the invention will now be discussed with reference to FIG. 1.

The insect detector sock 10 is placed on the user-exterminator or insect inspection agent (partially shown) prior to arriving at the location to be inspected.

Typically, the inspector's shoes or boots are then put on over the lower sock member 11. Next, the inspector may put on a pair of pants, with the trouser leg portions 16 on the outside of upper member 12. In this manner, the inspector may arrive at and travel between several inspection sites, for example, different houses, looking properly attired in typical street dress.

Just prior to performing the inspection and/or extermination procedure, the inspector/exterminator may roll or push upper member 12 over the inspector's 18 pants legs 16 as illustrated for one leg in FIG. 1. One or more barrier band 14 may then be placed about upper member 12.

The inspector 18 (partially shown) then proceeds to walk about the inspection site while observing if, when, where and quantity of ticks (or other inspects) accumulate on upper member 12.

Based on the Inspector's expertise, he may stand at selected site locations for desired periods of time in order to attract the ticks etc. For example he may pause or stop next to stone walls and other typical gathering places of ticks.

Following the inspection and/or extermination process, the inspector 18 may use a brush or adhesive tool or other instrument to remove any ticks or other insects off the detector sock 10.

Next, the barrier band 14 may be removed and the upper member 12 reinserted under the trouser legs 16 of the inspector in order to present once again a typical street dress appearance.

This procedure may be followed at each different inspection (house/office/yard) site.

DESCRIPTION OF ALTERNATIVE EMBODIMENT

With reference now to FIG. 2, an alternative embodiment 20 of the invention apparatus and method will now be discussed.

Detector sock 20 generally comprises a sock like garment 21 sized to fit over the inspector's shoe 22, and has an upper section 23 sized to fit over the pants and leg of the inspector. The length of upper section 23 preferable should extend above the knee of the inspector.

A barrier means 24 is affixed about upper section 23 for preventing ticks and other crawling insects from coming into contact with the inspector. The barrier means 24 may comprise a double sided tape similar to that utilized with the preferred embodiment illustrated in FIG. 1, or may comprise a permanently affixed, sewn, barrier about upper section 23.

The bottom section of sock garment 21 has a shoe like sole member 25 formed, for example, of soft flexible rubber or other suitable material. Sole member 25 is affixed to sock garment 21 in conventional manner such as sewn (not shown) thereto.

Securing means 26 is provided to maintain the upper section 23 in place about the upper leg of the inspector. Securing means 26 may be formed of an a tie string, elastic band, strap or other suitable conventional securing device.

OPERATION OF THE ALTERNATIVE EMBODIMENT

The operation of the alternative embodiment will now be described with reference to FIG. 2.

A detector sock 20 is place on each foot and leg of the inspector/exterminator 18. Each detector sock 20 may be placed over the shoes of the inspector/exterminator 22, or he may desire to remove his street shoes first. Each upper section 23 (only one shown) is fitted over the leg and pants 16 of the inspector/exterminator.

The inspection/extermination process then proceeds in a manner similar to that described above with reference to FIG. 1.

At the conclusion of the inspection or extermination, the detector socks 20 are removed and stored in a container means such as a plastic bag. In this manner, any ticks or insects which may remain on the detector socks 20 are contained and can be later disposed of.

A new pair of detector socks 20 may be used at each inspection site, for example, each different house or yard, etc.

Obviously, numerous modifications and variation of the present invention are possible in light of the above teachings. It is therefore to be understood that within the scope of the appended claims, the invention may be practiced otherwise than that as specifically described herein. The term "insect infestation inspector" shall mean throughout an individual who makes inspections of premises to determine if ticks or other crawling insects are present at a location and/or an individual who performs insect extermination services typically referred to as an insect exterminator.

The term—clingy material—shall hereinafter be defined to mean a material or fabric which is a knit or napped surface material or a cotton or wool fabric or similar material having fibrous textured surfaces, i.e., not relatively smoothed such as plastic or tightly woven nylon or silk having a slippery surface.

The term—light color—shall hereinafter be defined to mean a color substantially different from the predominant color of the insect being detected, located or inspected or monitored by an insect infestation inspector. For example, a white color being used when inspecting for ticks which generally have a dark or black coloration. In this manner a black colored insect may be easily visually detected or spotted against the white background color of the legging means 12. Thus, a dark color such as a royal blue or black is not used as the color of the legging means 12, 23.

The term—exposed surface portion—shall hereinafter be defined to mean an adhesive material forming a sticky surface on the outside of the legging means exposed to the environment circumferentially about a portion of the legging means.

I claim:

1. An insect detector article of clothing for being worn on a foot and a leg portion of a person doing insect infestation inspections, comprising:

a sock member (11, 21) dimensioned for receiving the person's foot therein;

legging means (12, 23) having a tubular configuration and being affixed (15) at a bottom portion to said sock member and having an open top portion dimensioned for receiving therein the leg portion of the person, and being formed of a clingy material for enabling insects to cling thereto, and being of a light color for facilitating the person doing the insect inspections with relative ease to visually detect insects clinging on said legging means; and a barrier member (14, 24) circumferentially affixed about a top portion (17) of said legging means and having adhesive material on an exposed surface portion.

2. An insect detector article of clothing as in claim 1, including:

means (13,26) for holding said legging means on the leg of the insect infestation inspector.

3. An insect detector article of clothing as in claim 1, wherein:

the legging means is designed to extend from the ankle to the thighs of the insect infestation inspector.

4. An insect detector article of clothing as in claim 1, wherein:

said adhesive material is (14) disposed circumferentially about said legging means for entrapping ticks thereto.

5. An insect detector article of clothing as in claim 1, wherein:

said barrier member comprises a circumferential band (14) removably mounted to said legging means and having an outer surface means for entrapping ticks and other arachnids.

6. An insect detector article of clothing as in claim 1, wherein:

the sock member (21) is designed for being fitted over the foot wear of the insect infestation inspector and having a rubber sole member (25).

7. An insect detector article of clothing as in claim 1, including:

a tie string means (26) about the top portion of said legging means for maintaining said legging means on the inspector's leg.

* * * * *